US011659923B2

(12) United States Patent
Kondel

(10) Patent No.: US 11,659,923 B2
(45) Date of Patent: May 30, 2023

(54) MOBILE TABLE WITH SELECTIVELY ROTATING TABLE TOP

(71) Applicant: Roots Engineering Services, Venice, FL (US)

(72) Inventor: Jeffrey M. Kondel, Venice, FL (US)

(73) Assignee: ROOTS ENGINEERING SERVICES, Venice, FL (US)

( * ) Notice: Subject to any disclaimer, the term of this patent is extended or adjusted under 35 U.S.C. 154(b) by 0 days.

(21) Appl. No.: 17/568,013

(22) Filed: Jan. 4, 2022

(65) Prior Publication Data

US 2022/0211172 A1 Jul. 7, 2022

Related U.S. Application Data

(60) Provisional application No. 63/133,523, filed on Jan. 4, 2021.

(51) Int. Cl.
*A47B 13/08* (2006.01)

(52) U.S. Cl.
CPC .... *A47B 13/081* (2013.01); *A47B 2200/0036* (2013.01); *A47B 2200/0043* (2013.01)

(58) Field of Classification Search
CPC ..... A47B 13/081; A47B 2200/0042; A47B 2200/0036; A47B 2200/0043; A47B 27/18
See application file for complete search history.

(56) References Cited

U.S. PATENT DOCUMENTS 3,152,802 A * 10/1964 Heisler ..... A61H 1/0218 5/624
3,568,669 A * 3/1971 Stites ..... A61H 1/0218 601/24
3,589,358 A * 6/1971 Megal ..... A61H 1/0218 606/244
4,681,042 A * 7/1987 Roberts ..... A47B 27/18 108/6
4,717,148 A * 1/1988 Brewer ..... A61H 1/0218 482/144
7,544,157 B2 * 6/2009 Teeter ..... A61H 1/0218 482/145
9,937,941 B2 * 4/2018 Chen ..... B62B 3/005
2012/0228840 A1 * 9/2012 Qiang ..... A47B 3/002 280/42
2015/0223600 A1 * 8/2015 Pan ..... A47B 7/02 108/91

(Continued)

FOREIGN PATENT DOCUMENTS

FR 2290922 A1 * 6/1976
WO WO 9113722 A1 * 9/1990

*Primary Examiner* — Daniel J Rohrhoff
(74) *Attorney, Agent, or Firm* — Shumaker, Loop & Kendrick, LLP

(57) ABSTRACT

Disclosed are mobile tables and table assemblies having a selectively rotating table top relative to the table frame. A mobile table including a selectively rotatable table top that is configured to securely rotate about an axis in an unlocked position and to be secured in a predetermined plane in a locked position; and two spaced apart frame members securely connected to the selectively rotatable table top positioned on a first end of each spaced apart frame member and movement members attached to a second end of each spaced apart frame members that are configured to selectively move the mobile table to and from desired locations.

5 Claims, 15 Drawing Sheets

(56) References Cited

U.S. PATENT DOCUMENTS

| | | | | |
|---|---|---|---|---|
| 2016/0288280 | A1* | 10/2016 | Lin | B25J 5/007 |
| 2016/0324309 | A1* | 11/2016 | Kassanoff | A47B 13/081 |
| 2021/0068531 | A1* | 3/2021 | Tao | A47B 27/02 |

* cited by examiner

MOBILE TABLE WITH SELECTIVELY ROTATING TABLE TOP

TECHNICAL FIELD

The present invention generally relates to the field of tables and table assemblies, and more particularly, to mobile tables having a selectively rotating table top relative to its frame.

BACKGROUND

Many classroom and shop settings require the use of sturdy industrial strength tables and/or work tops/work benches. However, these industrial strength tables and tops are often very large, heavy, cumbersome, and partially or completely immobile. Furthermore, the above mentioned conventional tables and work tops span a large footprint within the classroom and/or work space, thus requiring large spaces for their use. However, in many settings (e.g., when work space is limited and/or mobility and space versatility is desired), the above mentioned characteristics are highly undesirable and are even sought to be avoided. Thus, alternative work tops and tables that directly address at least the above mentioned problems are needed.

SUMMARY

Disclosed herein are industrial strength tables that address the problems observed with conventional tables and work tops/benches in classroom and shop/work space settings. In particular, these tables are easily (and selectively) mobile from one location to another and the table top is selectively rotatable between a plurality of locked positions to advantageously increase the overall foot print while the table is in use (e.g., deploying the table top for use in a first position) and/or reduce the overall foot print (e.g., orienting the table top in a vertical second position) thereby advantageously allowing for storage in small spaces when one has finished the use thereof. More particularly and in certain aspects, disclosed is a mobile table including a selectively rotatable table top that is configured to securely rotate about an axis in an unlocked position and to be secured in a predetermined plane in a locked position; and two spaced apart frame members securely connected to the selectively rotatable table top that is positioned on a first end of each spaced apart frame member and with movement members attached to a second end of each spaced apart frame members that are configured to selectively move the mobile table to and from desired locations.

In certain aspects of the mobile table, each frame member includes two spaced apart frame legs that are connected to one another on the first end of the frame member by a cross-beam and the cross-beam of each frame member is co-planar relative to one another within the table.

In certain aspects of the mobile table, the selectively rotatable table top is configured to selectively rotate and lock in a clockwise or counterclockwise direction relative to the frame members.

In certain aspects of the mobile table, the selectively rotatable table top is configured to selectively rotate to and lock in a first position that is substantially coplanar with the cross-beams of each frame member of the table and in a second position that is substantially perpendicular relative to the cross-beams of each frame member of the table.

In certain aspects of the mobile table, the selectively rotatable table top is configured to selectively rotate and lock in a plurality of predetermined positions in between the first and second positions.

In certain aspects of the mobile table, the mobile table further includes a stationary storage shelf affixed to the mobile table between the two spaced apart frame members and below the selectively rotatable table top, the stationary storage shelf being more proximate to the second end of each spaced apart frame member than the first end of each spaced apart frame member to provide sufficient clearance for the selectively rotatable table top such that the selectively rotatable table top can rotate 360° about the axis in an unlocked position relative to the two spaced apart frame members.

In certain aspects of the mobile table, the stationary storage shelf is in a parallel plane relative to the cross-beams of each frame member.

In certain aspects of the mobile table, the mobile table further includes two rotatable bushings, with each bushing positioned within the first end of the spaced apart frame member and extending internally within the table towards one another, the rotatable bushings are axially aligned with one another and have the selectively rotatable table top securely attached thereto with one rotatable bushing being operably connected to a handle such that when handle is moved/rotated the two rotatable bushings and selectively rotatable table top move in concert with the handle between desired unlocked and locked positions.

In certain aspects of the mobile table, the table further includes a locking mechanism configured to selectively lock and unlock the selectively rotatable table top in predetermined positions relative to the two spaced apart frame members.

In certain aspects of the mobile table, the rotatable bushing that is operably connected to the handle is coupled to a rotating disc having a plurality of through holes positioned thereon, the rotating disc configured to move in concert with the handle, two rotatable bushings, and selectively rotatable table top such that the locking mechanism selectively engages and disengages the through holes of the rotating disc to obtain the desired unlocked and locked positions of the selectively rotatable table top.

In additional aspects, also disclosed is a mobile table assembly including (a) a plurality of movement members that are configured to selectively move the mobile table to and from desired locations; (b) a selectively rotatable table top that is configured to rotate and lock in a plurality of different positions relative to two spaced apart frame members; and (c) two spaced apart frame members configured for secure connection to the selectively rotatable table top positioned there between on a first end of each spaced apart frame member and with at least one of the plurality of movement members attached to a second end of each spaced apart frame members.

In certain aspects of the table assembly, each frame member comprises two spaced apart frame legs that are connected to one another on the first end of the frame member by a cross-beam and the cross-beam of each frame member is co-planar relative to one another when assembled within the table.

In certain aspects of the table assembly, the selectively rotatable table top is configured to selectively rotate and lock in a clockwise or counterclockwise direction relative to the frame members.

In certain aspects of the table assembly, the selectively rotatable table top is configured to selectively rotate to and lock in a first position that is substantially coplanar with the cross-beams of each frame member of the table and in a second position that is substantially perpendicular relative to the cross-beams of each frame member of the table when assembled.

In certain aspects of the table assembly, the selectively rotatable table top is configured to selectively rotate and lock in a plurality of predetermined positions in between the first and second positions when assembled within the table.

In certain aspects of the table assembly, the assembly further includes a stationary storage shelf configured for attachment to the mobile table between the two spaced apart frame members and to be positioned below the selectively rotatable table top, the stationary storage shelf configured to be more proximate to the second end of each spaced apart frame member than the first end of each spaced apart frame member to provide sufficient clearance for the selectively rotatable table top such that the selectively rotatable table top can rotate 360° about the axis in an unlocked position relative to the two spaced apart frame members when assembled within the table.

In certain aspects of the table assembly, the stationary storage shelf is configured to be in a parallel plane relative to the cross-beams of each frame member.

In certain aspects of the table assembly, the assembly further includes two rotatable bushings, with each bushing positioned within the first end of the spaced apart frame member and extending internally within the table towards one another when the table is assembled, the rotatable bushings are configured to be axially aligned with one another and have the selectively rotatable table top securely attached thereto with one rotatable bushing configured to be operably connected to a handle such that when the table is assembled and the handle is moved/rotated the two rotatable bushings and selectively rotatable table top move in concert with the handle between desired unlocked and locked positions.

In certain aspects of the table assembly, the assembly further includes a locking mechanism configured to selectively lock and unlock the selectively rotatable table top in predetermined positions relative to the two spaced apart frame members.

In certain aspects of the table assembly, the rotatable bushing that is configured to be operably connected to the handle is coupled to a rotating disc having a plurality of through holes positioned thereon, the rotating disc is configured to move in concert with the handle, two rotatable bushings, and selectively rotatable table top when the table is assembled such that the locking mechanism is configured to selectively engage and disengage the through holes of the rotating disc to obtain the desired unlocked and locked positions of the selectively rotatable table top.

In certain aspects, a plurality of the tables/table assemblies disclosed herein may be interconnected to one another, to form various types of work stations having various configurations for various different purposes (e.g., education/lab purposes, production line assembly, etc.). Due to the unique features of each table included in the work stations, these work stations may be easily (either partially or completely) assembled and/or disassembled. Moreover, these work stations are advantageously very mobile (as a complete work station or a partial work station), capable of being moved from one location to another within, for example, a class room and/or factory.

Embodiments of the invention can include one or more or any combination of the above features and configurations.

Additional features, aspects and advantages of the invention will be set forth in the detailed description which follows, and in part will be readily apparent to those skilled in the art from that description or recognized by practicing the invention as described herein. It is to be understood that both the foregoing general description and the following detailed description present various embodiments of the invention, and are intended to provide an overview or framework for understanding the nature and character of the invention as it is claimed. The accompanying drawings are included to provide a further understanding of the invention, and are incorporated in and constitute a part of this specification.

BRIEF DESCRIPTION OF THE DRAWINGS

These and other features, aspects and advantages of the present invention are better understood when the following detailed description of the invention is read with reference to the accompanying drawings, in which.

DETAILED DESCRIPTION

The present invention will now be described more fully hereinafter with reference to the accompanying drawings in which exemplary embodiments of the invention are shown. However, the invention may be embodied in many different forms and should not be construed as limited to the representative embodiments set forth herein. The exemplary embodiments are provided so that this disclosure will be both thorough and complete, and will fully convey the scope of the invention and enable one of ordinary skill in the art to make, use and practice the invention. Like reference numbers refer to like elements throughout the various drawings.

FIGS. 1-11 depict the table/table assembly 100 disclosed herein. In certain aspects, various components of the table/table assembly 100 are comprised of aluminum or steel components such that the table assembly is durable and has industrial strength. It should be further noted that these table assemblies include swivel casters 2 (movement members) allowing for selectively mobility of the assembly around, for example, a shop or a classroom. In certain aspects, these swivel casters 2 are further equipped with brakes to further selectively control movement of the assembly and to further achieve/maintain stationary positioning as desired by the assembly user.

Figure 8:
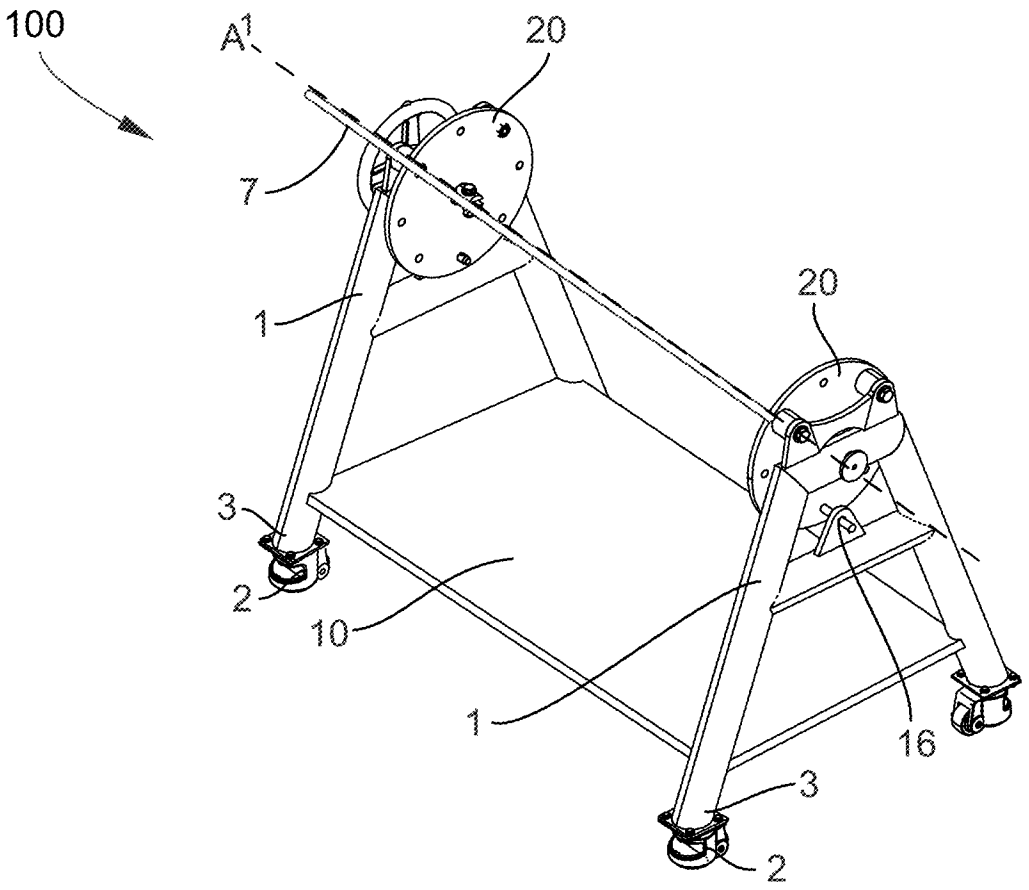
FIG. 8 depicts a perspective view of the assembled table with the selectively rotatable table top selectively rotated and locked into an intermediate position (i.e. a position between the first and second positions)
Figure 9:
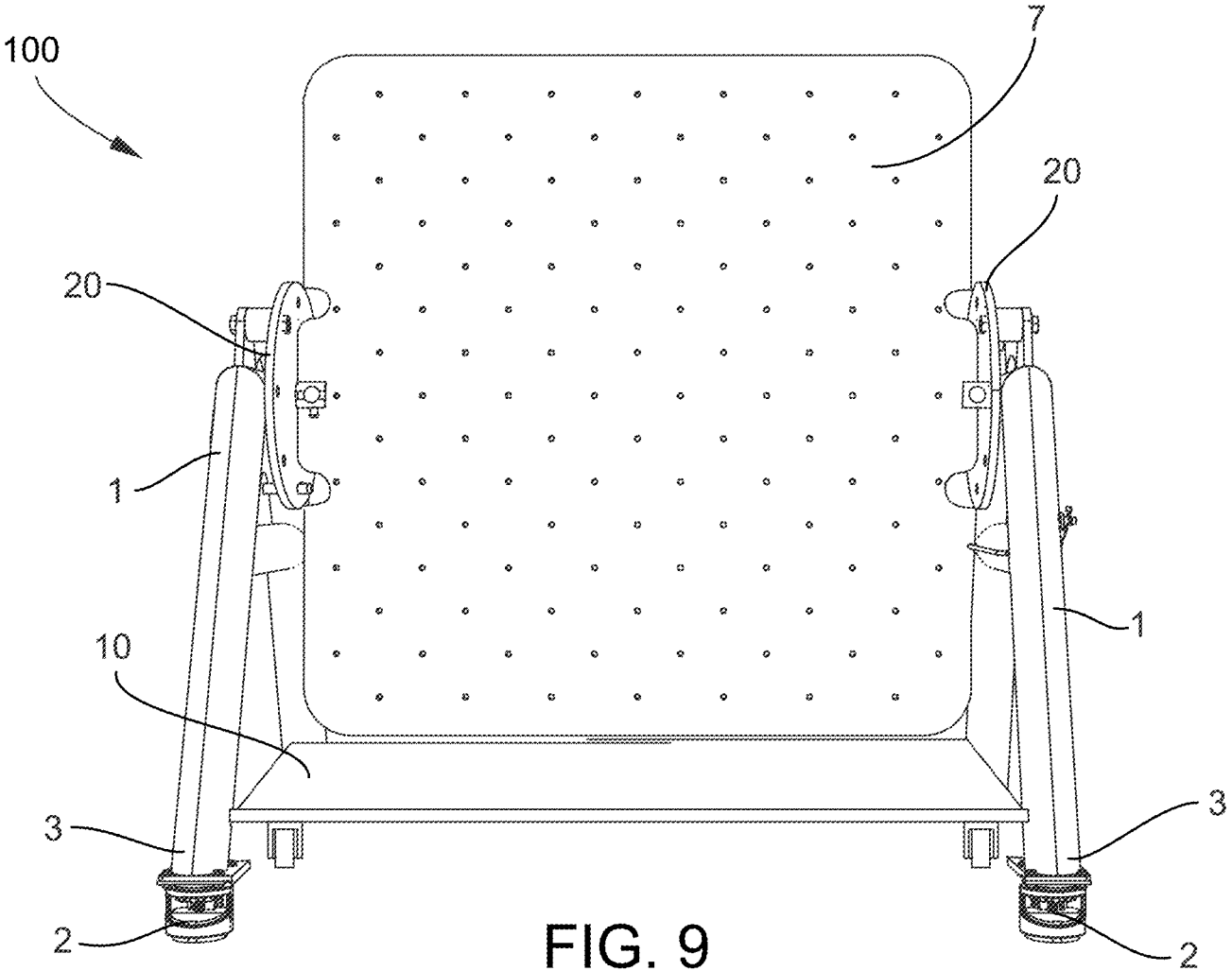
FIG. 9 depicts a perspective view of the assembled table with table top selectively rotated and locked into a vertical position (second position)
Figure 10:
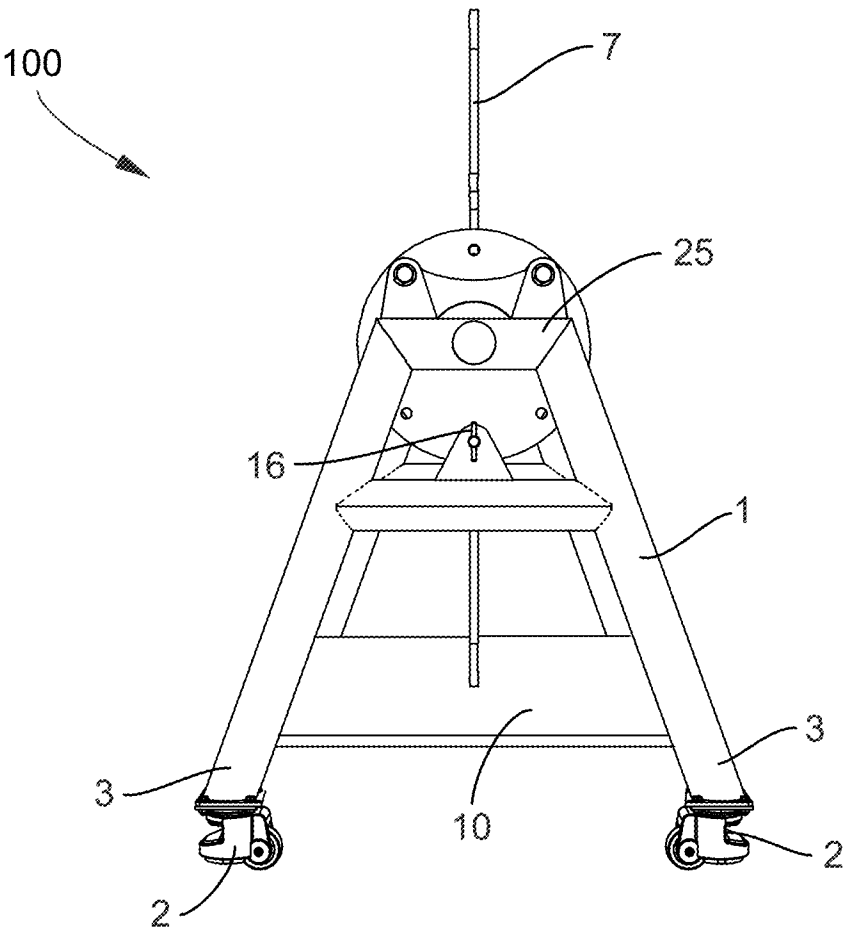
FIG. 10 depicts a side view of the assembled table with the table top selectively rotated and locked into a vertical position (second position)
Figure 11:
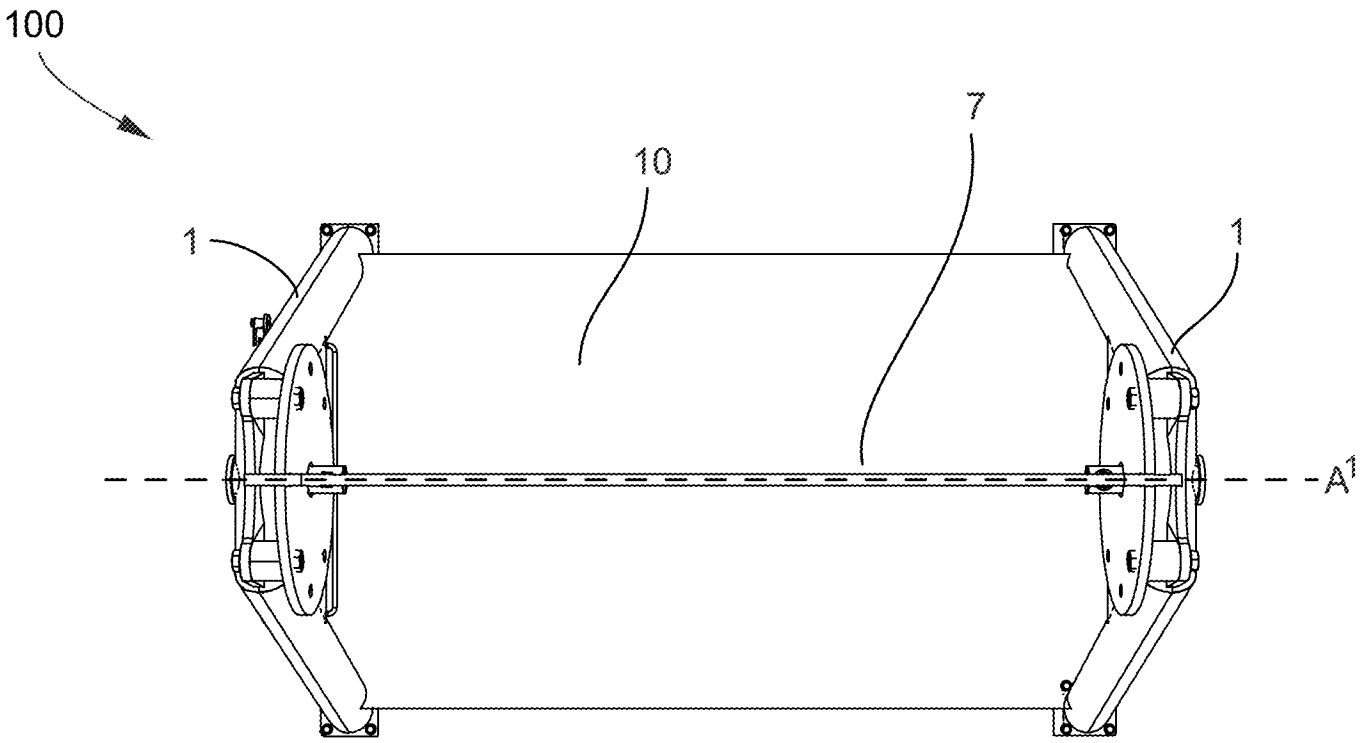
FIG. 11 depicts a top view of the assembled table with table top selectively rotated and locked into a vertical position (second position)

As further shown in FIGS. 1-11, when the table assembly 100 is assembled, the table assembly is configured such that the table top 7 is selectively rotatable relative to the frame 1 such that a plurality of fixed positions may be achieved. For example, FIGS. 1, 3, 6, and 7 depict the assembled table with the table top secured in a horizontal position (first position) (e.g., table top is in a parallel plane relative to shelf 10). FIG. 8 depicts a perspective view of the assembled table with table top selectively rotated into an intermediate position (i.e., a position between the first and second positions), and FIGS. 9-11 the assembled table with table top selectively rotated into a vertical position (second position) (e.g., table top is substantially perpendicular relative to shelf 10). The ability to selectively rotate the table top 7 at different angles allows a user to reduce the overall foot print of the assembly, advantageously allowing for storage in small spaces.

In certain aspects, the table top 7 can rotate and lock at +/−45°, +/−90°, and +/−180 and/or at other desired, predetermined increments within the 360° rotational axis of the table top (e.g., +/−15° increments, etc.). To achieve the above mentioned rotation and table top positions, the table assembly 100 is equipped with an easy-to-turn spoke wheel (handle) 13, bushings 4, alignment bolts, spacers 6, pads, and two locking wheels 20 with a plurality of through holes 21 arranged thereon to ensure a solid and predictable angle.

Figure 1:
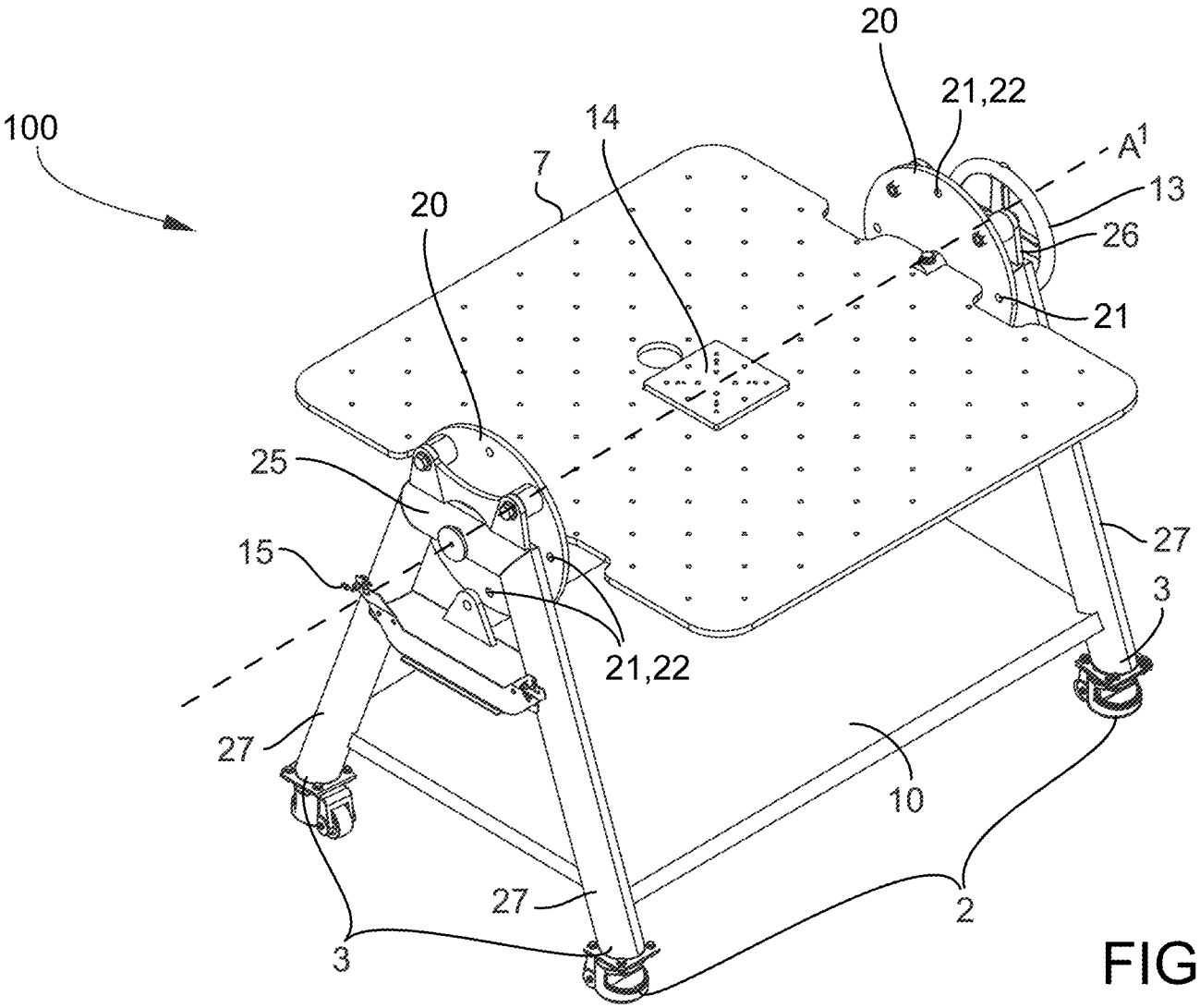
FIG. 1 depicts the assembled table with the selectively rotatable table top secured in a horizontal position (first position)
Figure 2B:
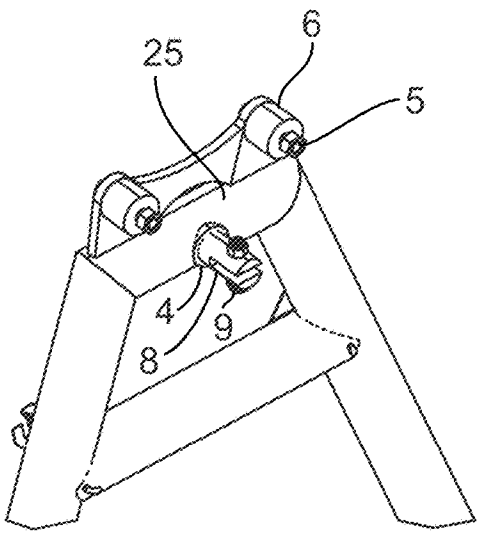
FIG. 2B depicts a magnified view of Detail A of FIG. 2A.
Figure 2A:
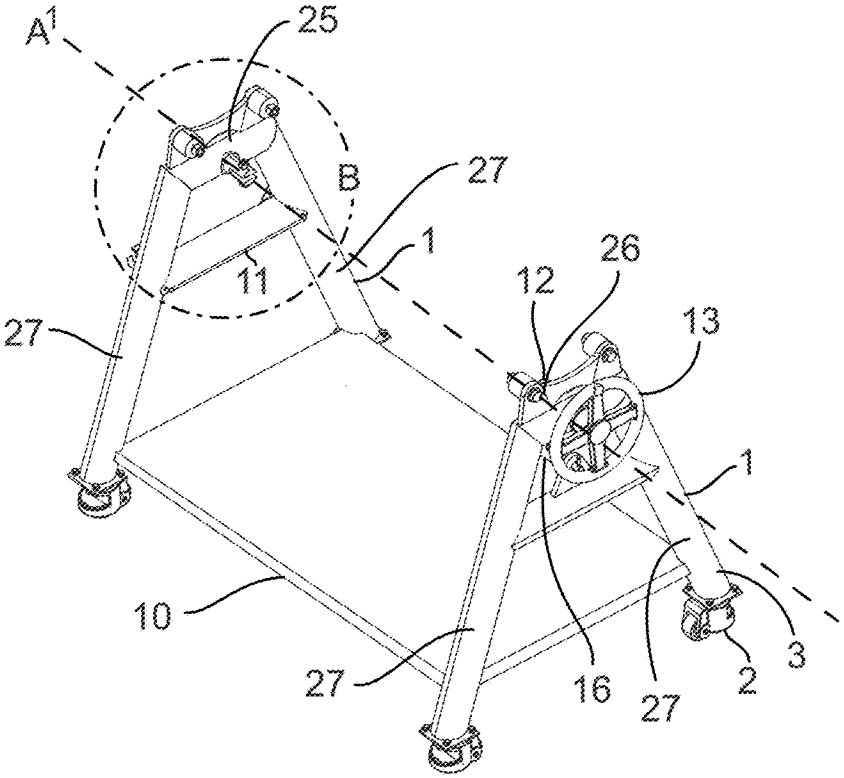
FIG. 2A depicts a partially disassembled table assembly.
Figure 3:
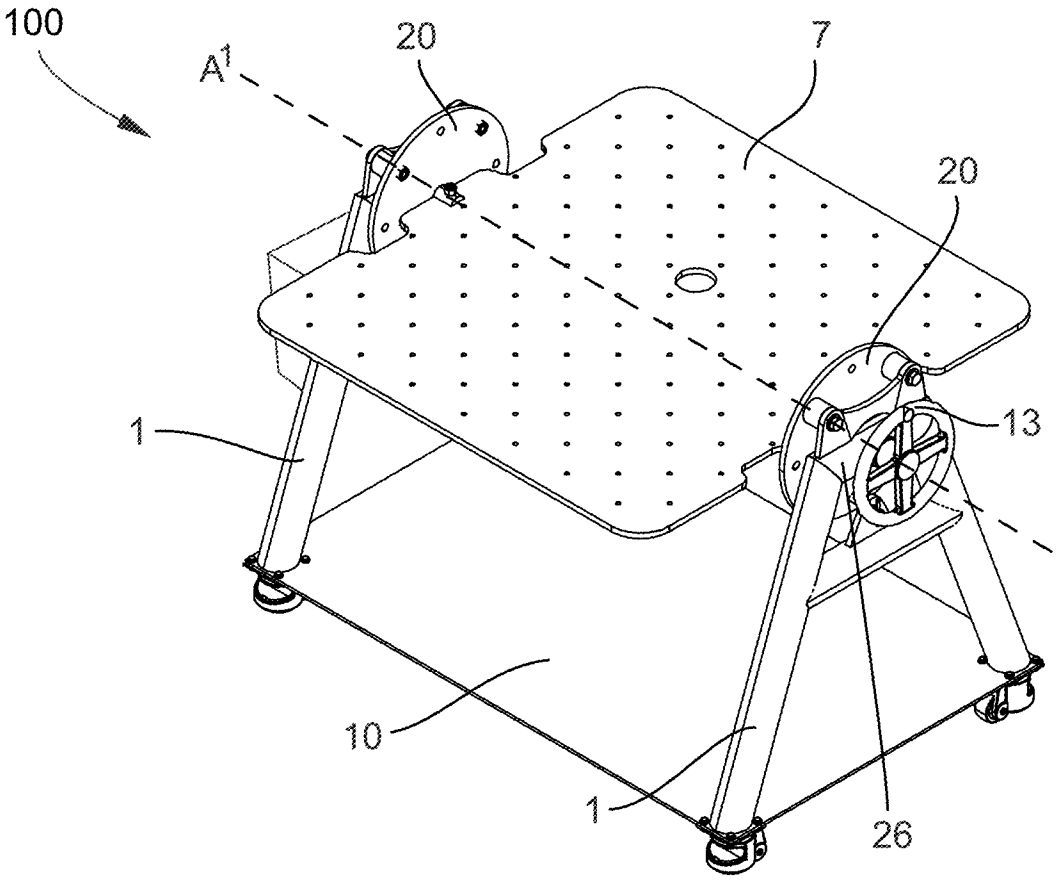
FIG. 3 depicts a perspective view of the assembled table with the selectively rotatable table top secured in a horizontal position (e.g., a first position)
Figure 4:
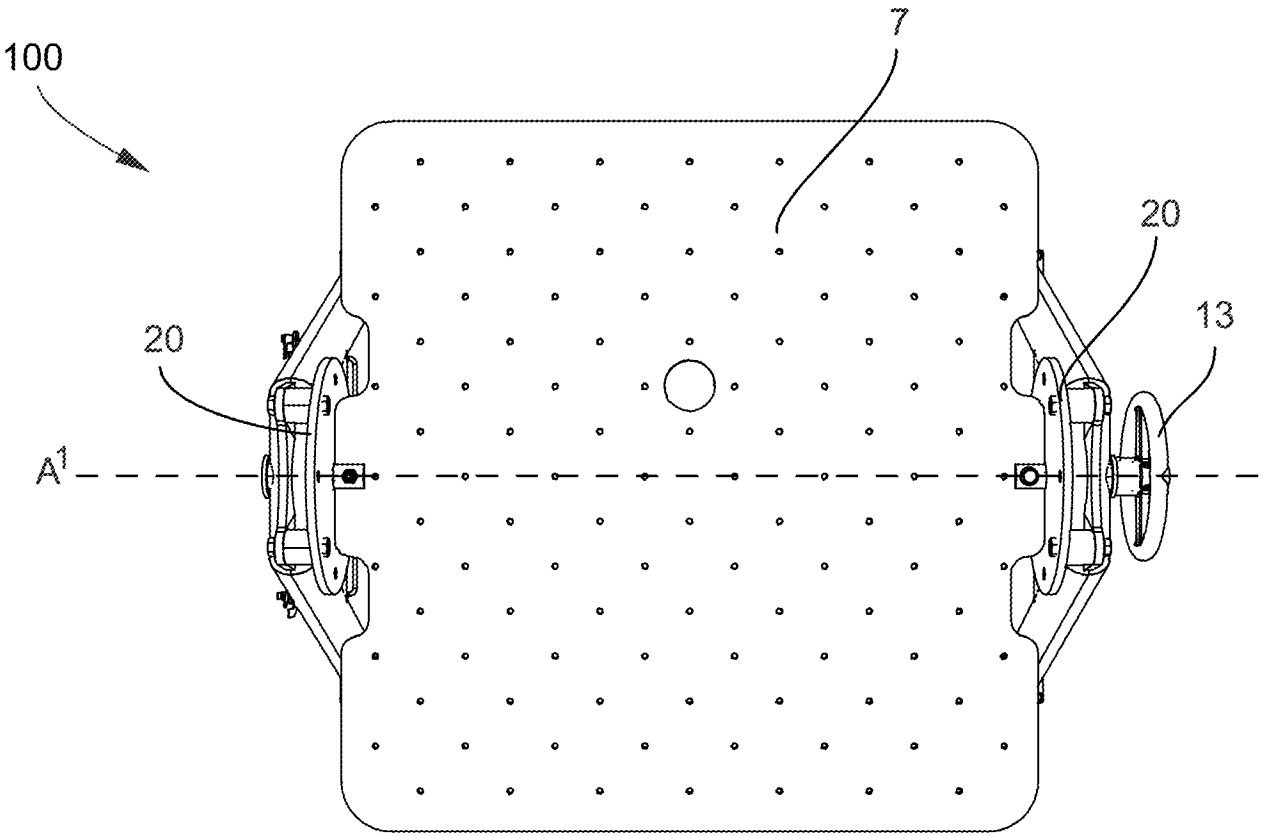
FIG. 4 depicts a top view of the assembled table with the selectively rotatable table top secured in a horizontal position.
Figure 5:
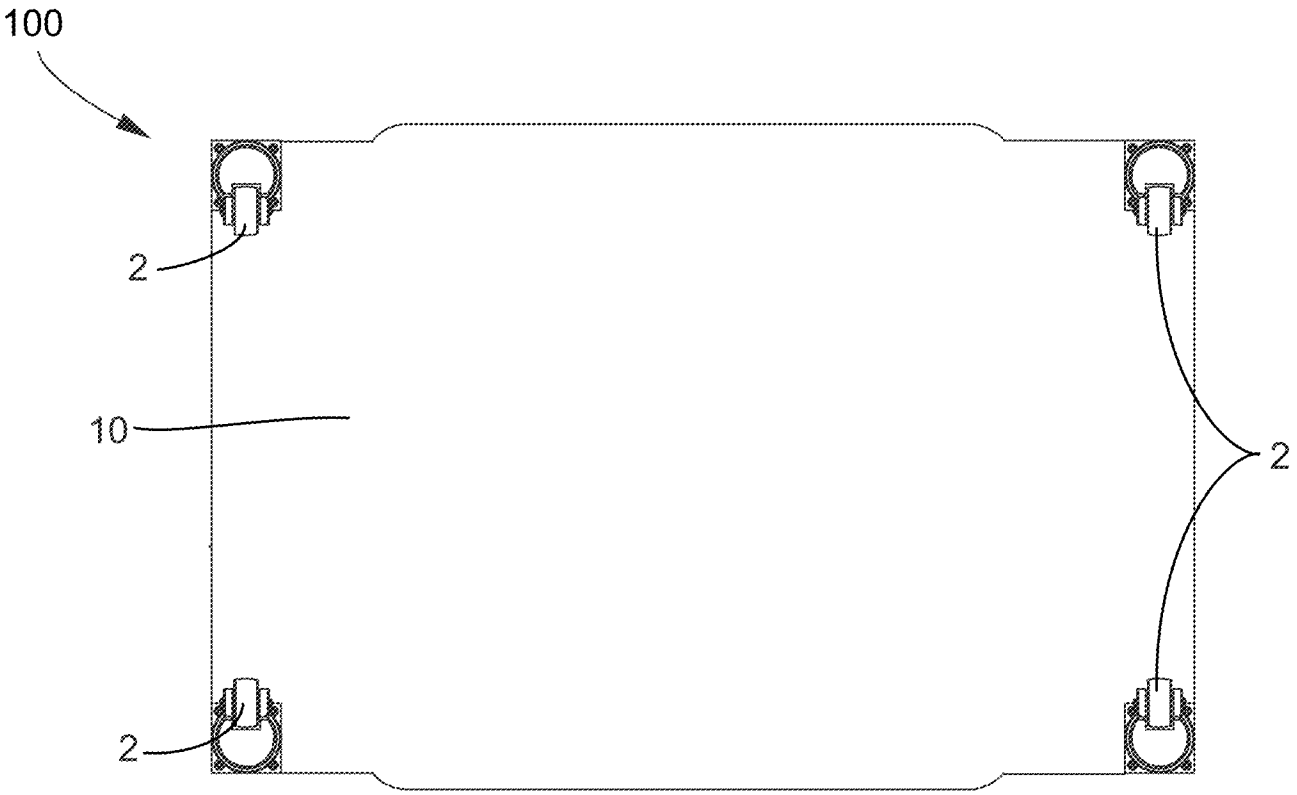
FIG. 5 depicts a bottom view of the assembled table.
Figure 6:
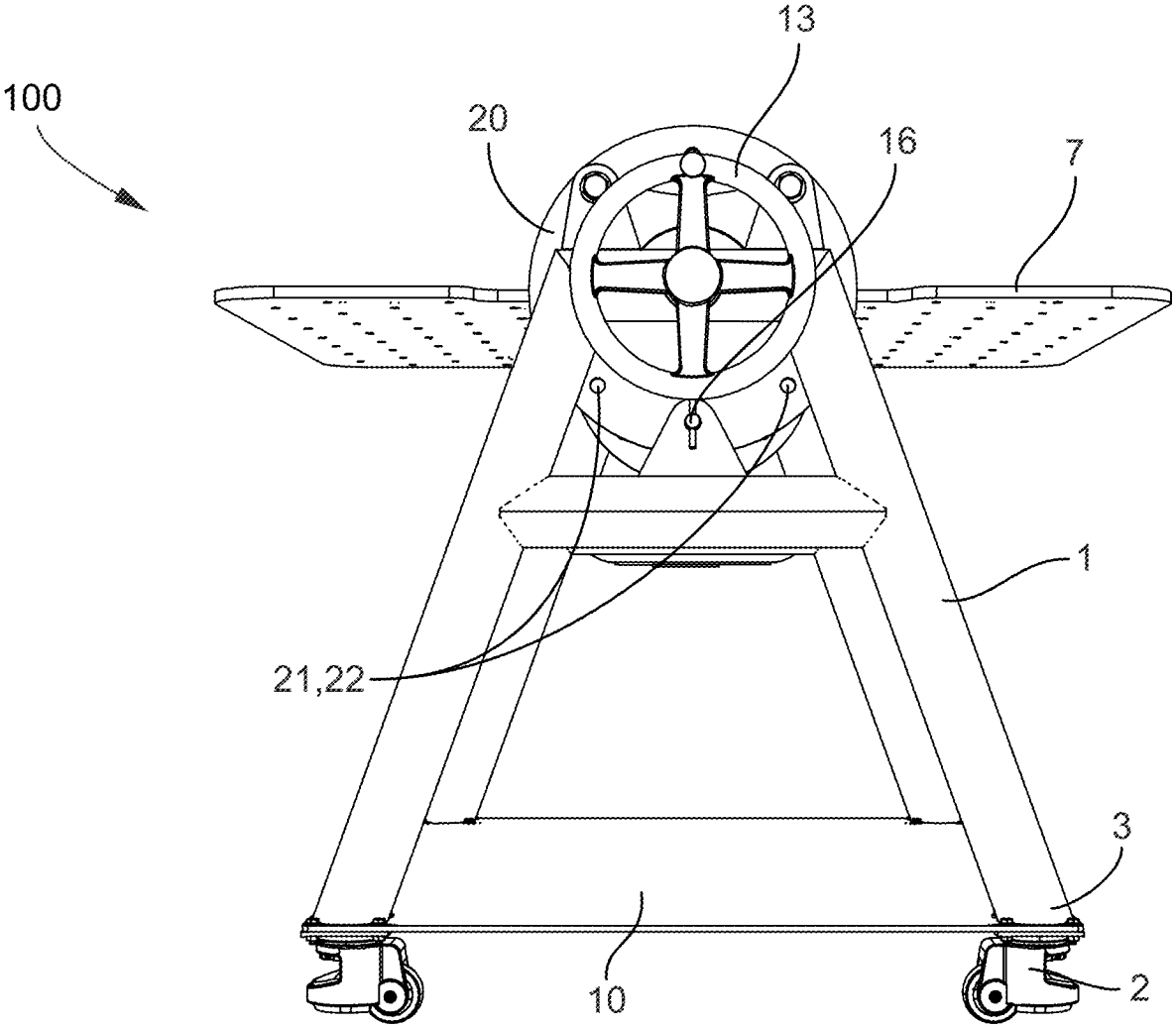
FIG. 6 depicts a right side view of the assembled table with the table top secured in a horizontal position.
Figure 7:
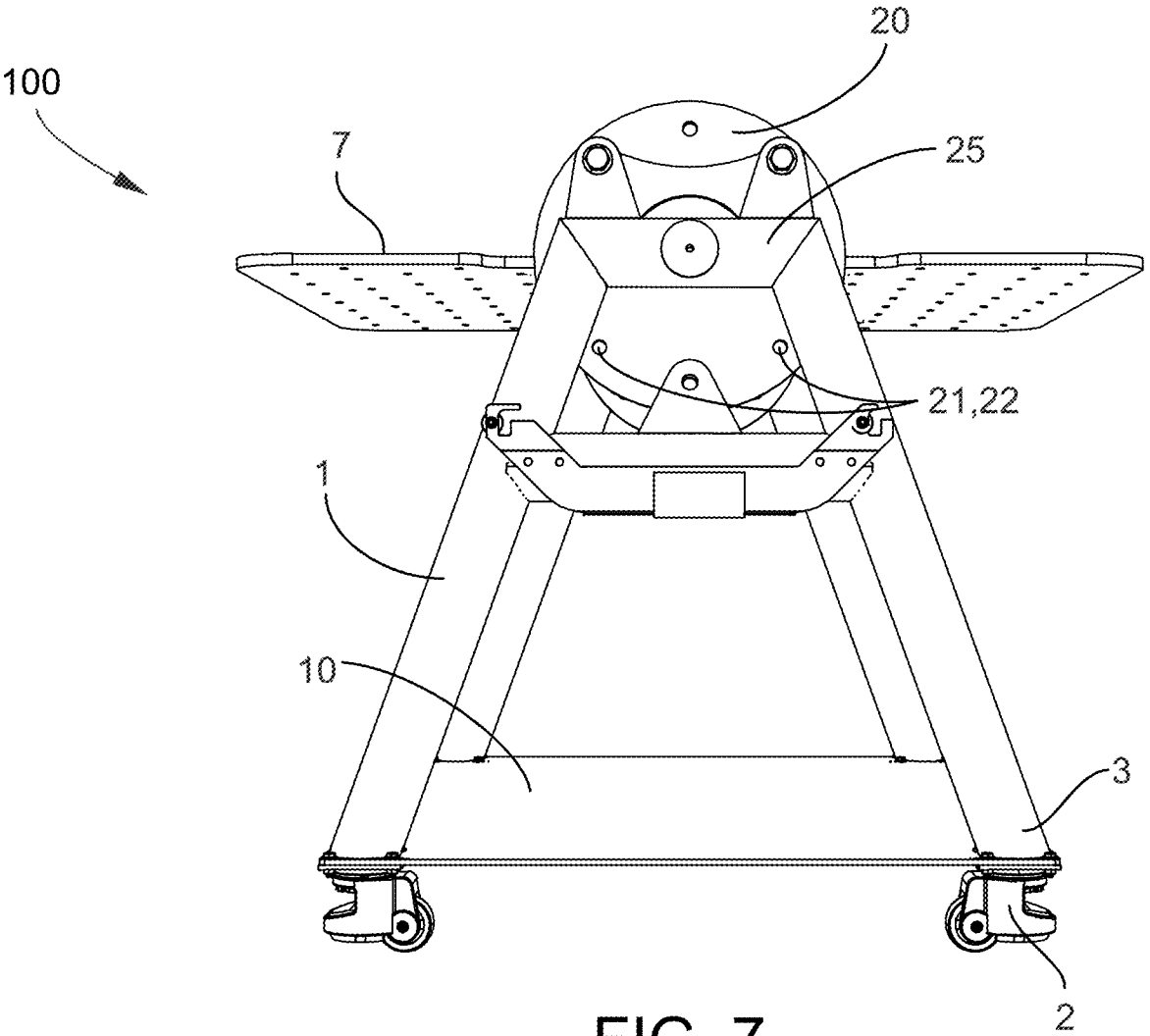
FIG. 7 depicts a left side view of the assembled table with the selectively rotatable table top secured in a horizontal position (e.g., a first position)

With specific reference to FIGS. 1, 2A, and 2B, two rotatable bushings 4 are positioned on opposite sides of the frame 1 and are axially aligned with one another. At least one bushing 4 is operably connected to handle 13 such that when handle 13 is moved/rotated the operably connected bushing moves in concert with the handle. As further shown in FIG. 2B, recesses are formed within each bushing such that the table top 7 is received there through and is affixed therein with, for example, a fastener, locking pin, and/or friction fit. As further shown in FIG. 1 in view of FIGS. 2A and 2B, locking wheels 20 are arranged on the frame and are connected to bushings 4. Each locking wheel 20 includes a plurality of through holes 21, and when assembled, the through holes of each locking wheel are axially aligned with a corresponding through hole of a corresponding locking wheel. The through holes 21 of each locking wheel 20 are arranged to align with spacers 6 and to be temporarily affixed to the frame by lock wheel hardware 5 that temporarily locks the locking wheels 20 into a desired position. A spring biased quick release locking pin 16 is also arranged on the frame 1. The spring biased quick release locking pin 16 further engages a through hole 21 of at least one locking wheel 20 to maintain table top position regardless of whether the locking wheels are (or are not) temporarily affixed to the frame by lock wheel hardware 5.

When moving the table top 7 from a first position (e.g., horizontal position) to another desired position, the lock wheel hardware 5 is initially removed and the spring biased quick release locking pin 16 is subsequently disengaged such that the locking wheels 20, bushings 4, and table top 7 are rotatable relative to the frame 1. Next, the table top 7 is rotated to the desired position by rotating handle 13 which further rotates each bushing 4, locking wheel 20, and table top 7 in concert. The desired through hole 21, 22 of at least one locking wheel 20 is aligned with the spring biased quick release locking pin 16 and the spring biased quick release locking pin 16 subsequently engages the desired locking wheel through hole. Next, the locking through holes 21 that are aligned with the spacers 6 are subsequently affixed thereto by locking wheel hardware 5, thus locking table top 7 into a desired position.

As further shown in FIGS. 1-11, the table assembly 100 further includes shelf 10 that is connected to the bottom of frame 1. In certain aspects, shelf 10 is detachable along with the table top 7 for ease of shipping and assembly. For those that require shipping, the table legs can be easily unbolted and two bolts connecting the table can be removed and now the table can be stacked on a pallet.

Figure 13:
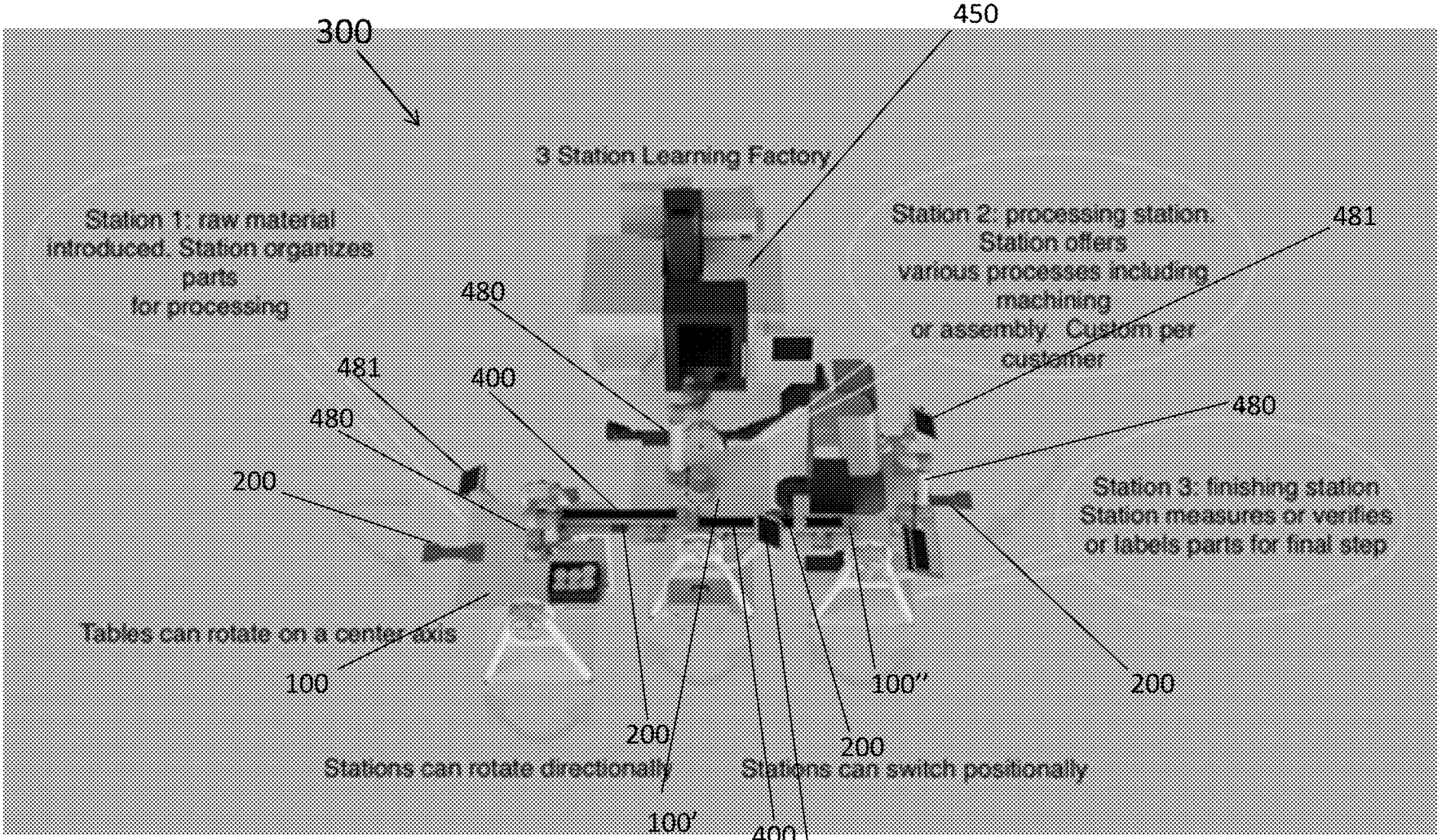
FIG. 13 depicts a work station comprising three tables that are sequentially interconnected to one another by two separate fastening devices positioned between and fastened to the respective tables within this work station.
Figure 14:
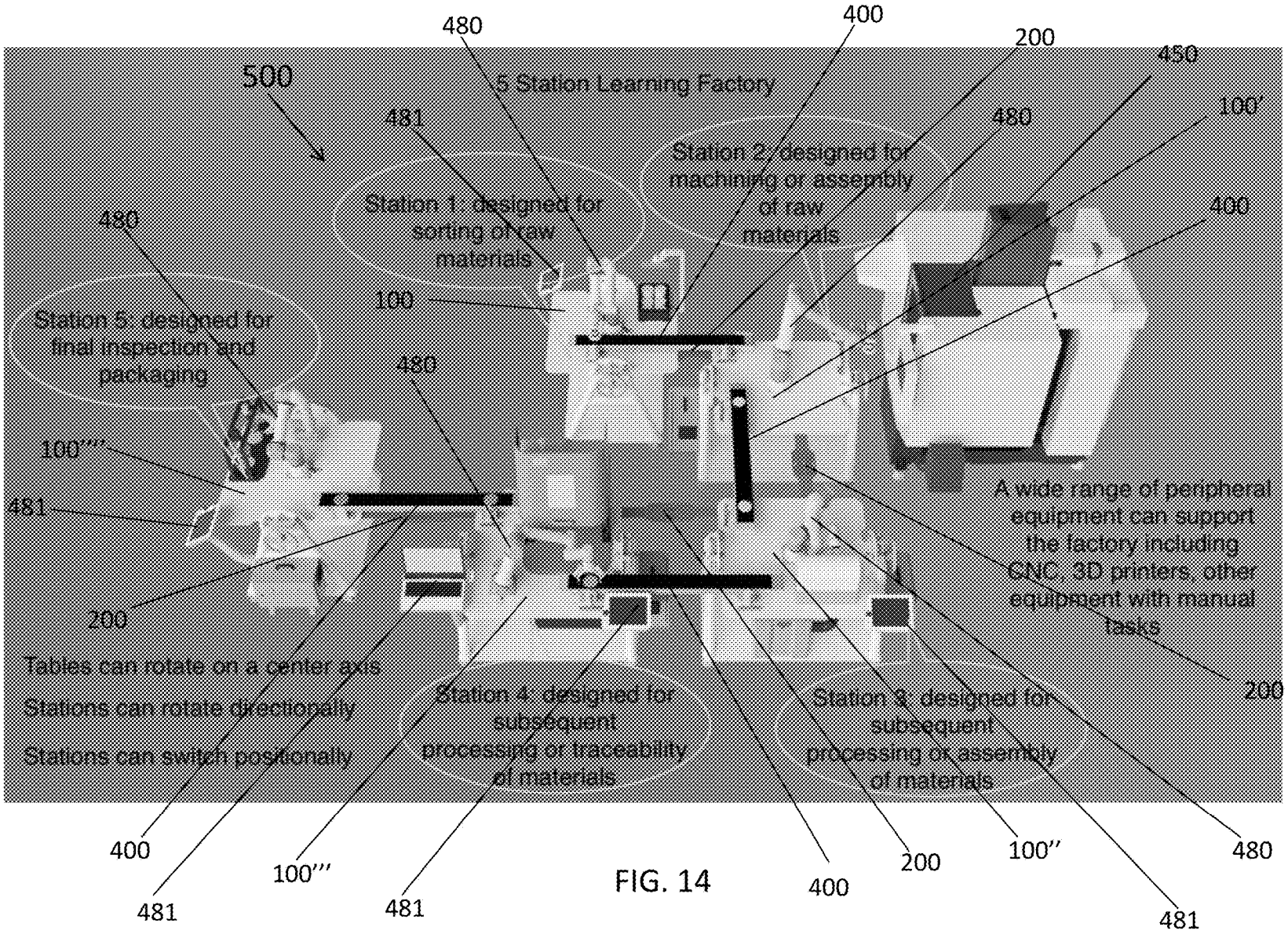
FIG. 14 depicts a work station comprising five tables that are sequentially interconnected to one another by four separate fastening devices positioned between and fastened to the respective tables within this work station.

In certain aspects and as shown, for example, in FIGS. 13 and 14, it is envisioned that a plurality of the above disclosed tables/table assemblies 100 may be interconnected to one another, to form various types of work stations 300, 500 having various configurations for various different purposes (e.g., education/lab purposes, production line assembly, etc.). Due to the unique features of each table included in the contemplated work stations, these work stations may be easily (either partially or completely) assembled and disassembled. Moreover, these work stations are advantageously very mobile (as a complete work station or a partial work station), capable from one location to another within, for example, a class room and/or factory thus allowing for a particular space to have more than one dedicated use.

Figure 12A:
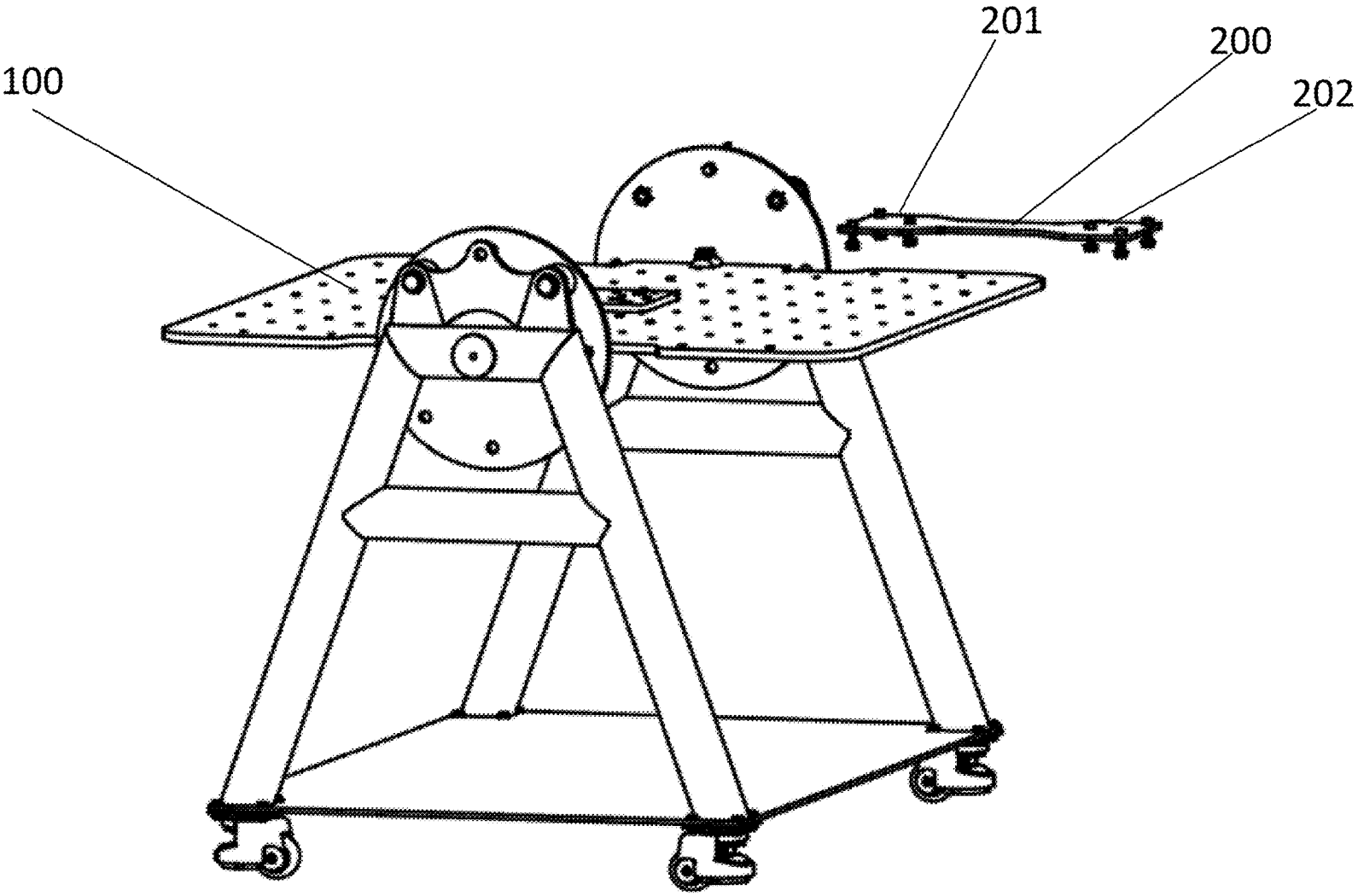
FIG. 12A depicts the fastening device before fastening to a selectively rotatable table top of a first table.
Figure 12B:
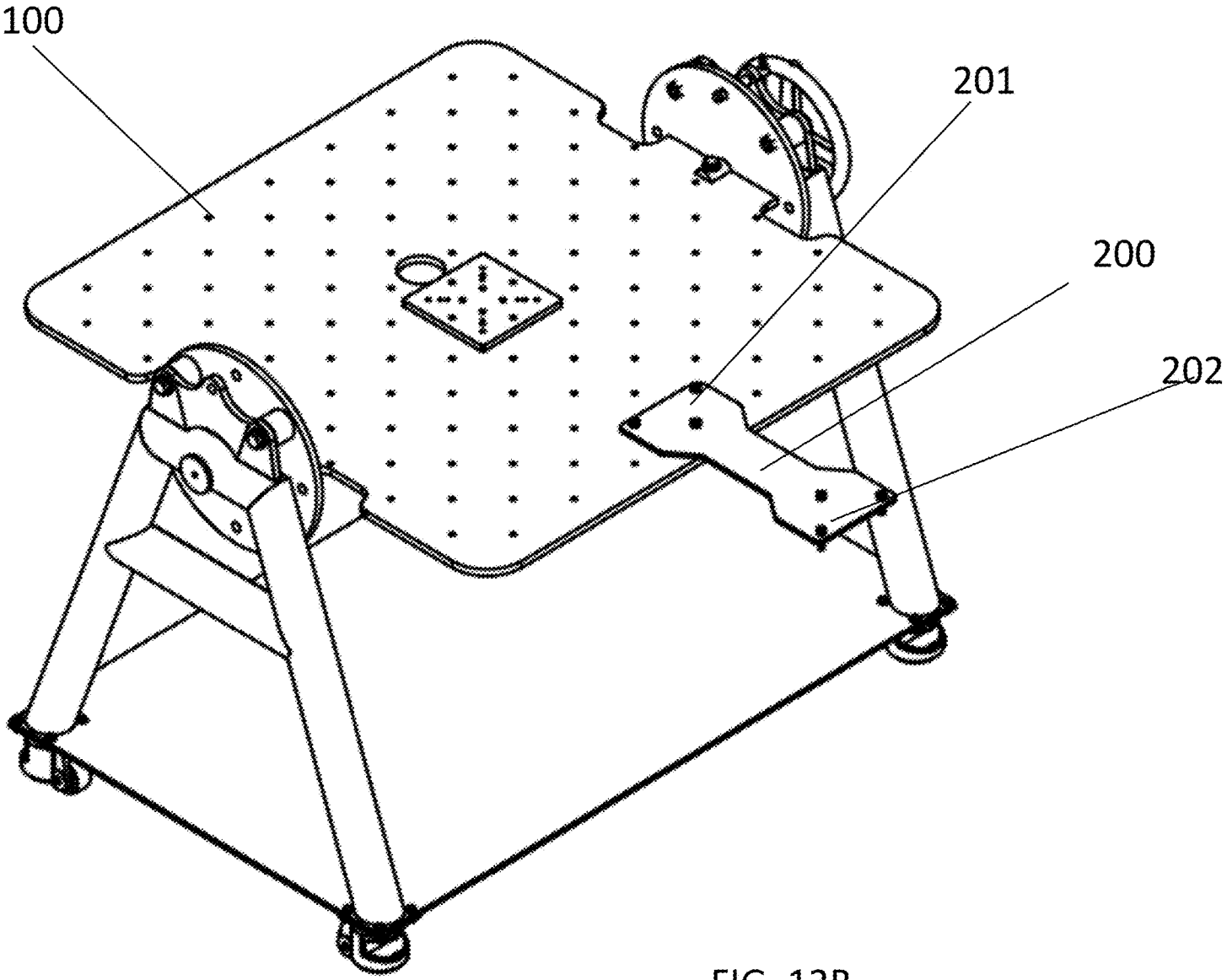
FIG. 12B depicts a first end of the fastening device fastened to a selectively rotatable table top of a first table and the second end of the fastening device that is free and configured for fastening to a selectively rotatable table top of a second table.

As shown, for example in FIGS. 12A and 12B, when assembling the contemplated work stations, at least one fastening device 200 is needed to interconnect two separate tables. The fastening device 200 is configured to be positioned in between two respective tables and to be fastened to the selectively rotatable table tops of a first and second table respectively such that the first and second tables are interconnected and fastened to one another via the fastening device 200. In certain preferred aspects and as depicted, for example, in FIGS. 13 and 14, the selectively rotatable table tops remain spaced apart from one another to allow the work station user greater mobility around the work station. As further depicted in FIGS. 12A and 12B, each fastening device has two spaced apart opposing ends (i.e., a first end 201 and a second end 202) that are each configured to fasten to a single selectively rotatable table top of separate tables. In certain aspects, the first end 201 and second end 202 are configured with either the same fastening means or a different fastening means, with the fastening means including, but not limited to, a snap fit engagement, friction fit engagement, or threaded engagement between the fastening device and the table tops of the tables 100. As shown, for example, in FIGS. 12A and 12B, the first end 201 and second end 202 of the fastening devices 200 are configured for a threaded engagement between each respective end 201, 202 of the fastening device and each respective table top of each respective table 100. In particular and with reference to FIGS. 12A and 12B, fastening device 200 may include one or a plurality of through holes positioned on and extending through each respective end 201, 202 of the fastening device 200, and these through holes are configured for alignment with corresponding through holes formed in (each and extending through) the selectively rotatable table top. As shown, for example in FIGS. 12A and 12B, when the through holes of the table top and end of the fastening device are aligned, a threaded fastener may be advanced through the aligned through holes (of the fastening device and the table top) to securely fasten one end of the fastening device 200 to a selectively rotatable table top. In FIG. 12B, the second end 202 of the fastening device is a free end, which may be subsequently fastened to selectively rotatable table top of another table.

In certain aspects, it is envisioned that a plurality of tables may be interconnected in the manner as described above. The plurality of tables may include two interconnected tables, three interconnected tables, four interconnected tables, five interconnected tables, six interconnected tables, or seven interconnected tables. In certain aspects and due to the overall size and limited mobility of the work stations, one will generally avoid interconnecting eight or more tables when forming the work stations disclosed herein, and in certain aspects, the number of interconnected tables ranges from two interconnected tables to five interconnected tables, as this number of tables maximizes workspace while achieving desired mobility and ease of assembly/disassembly of the work stations further disclosed herein.

FIGS. 13 and 14 depict two separate configurations of exemplary contemplated work stations 300, 500 respectively. FIG. 13 depicts a first exemplary work station having three tables (first table 100, second table 100', third table 100") that are sequentially arranged and interconnected to one another by fastening devices 200 arranged between and fastened to table tops of each table. Each table (100, 100', 100") of the work station 300 depicted in FIG. 13 further includes a computer(s) 480 operatively connected to a robotic arm(s) 481 positioned substantially within the middle of the table top of each table as well as conveyor belts 400 arranged between and connected to each table in a similar manner and alignment to the fastening devices previously disclosed above. Each computer 481 is operably connected to and configured to control the respective robotic arm 480 positioned on its table and to further process the materials positioned on that table as desired Once the desired processing has occurred, the processed materials are placed onto the conveyor belt 400 and conveyed to the next table within the work station. It is further contemplated that each work station may further be positioned adjacent to and/or further include, for example, a one or more CNC machines, one or more 3D printers, one or more other pieces of equipment configured to perform desired tasks, and/or any combination thereof.

Now, with specific reference to FIG. 13, raw materials, parts, etc. are initially placed on the first table 100 in work station 300 and are subsequently processed on the first table as desired by the work station user and/or by the robotic arm 480 controlled by computer 481. The processed materials from the first table 100 are then transported from the first table 100 to the second table 100' either manually or via a conveyor belt 400 positioned there between. Next and while on the second table 100', the materials are further processed by, for example, machining these materials and/or assembling these materials by the work station user and/or by the robotic arm 480 controlled by the computer on the second table and/or an additional machine such as a CNC machine or 3D printer (collectively 450) positioned on or adjacent to the second table 100'. After undergoing further processing on the second table 100', these materials are then transported from the second table 100' to the third table 100" either manually or via a conveyor belt 400 positioned there between. Next and while on the third table 100", the materials are further processed and/or finished by, for example, the work station user, by the robotic arm 480 controlled by computer 480, an additional machines positioned thereon, or any combination thereof. As depicted by the arrows in FIG. 13, the station 300 may be easily moved as a whole or partial unit (as desired by the work station user). Moreover, each individual table 100, 100', 100" within work station 300 has the functionality and mobility described above.

With specific reference to FIG. 14, which includes five tables (first table 100, second table 100', third table 100", fourth table 100', fifth table 100" ") in work station 500, raw materials are initially placed on the first table 100 in work station 500 and are subsequently processed on the first table as desired by the work station user and/or by the robotic arm 480 controlled by computer 481. The processed materials from the first table 100 are then transported from the first table 100 to the second table 100' either manually or via a conveyor belt 400 positioned there between. Next and while on the second table 100', the materials are further processed by, for example, machining these materials and/or assembling these materials by the work station user and/or by the robotic arm 480 controlled by the computer on the second table and/or an additional machine such as a CNC machine or 3D printer (collectively 450) positioned on or adjacent to the second table 100'. The processed materials from the second table 100' may be subsequently transported in a substantially similar manner to that described immediately above to third table 100" processed in a manner such as that depicted in FIG. 14 and then subsequently transport in a substantially similar manner to that described immediately above the fourth table 100'" to undergo further processing. After undergoing further processing on the fourth table 100'", these materials are then transported from the fourth table 100'" to the fifth table 100"" either manually or via a conveyor belt 400 positioned there between. Next and while on the fifth table 100"", the materials are further processed and/or finished by, for example, the work station user, by the robotic arm 480 controlled by computer 480, an additional machines positioned thereon, or any combination thereof. The workstation 500 depicted in FIG. 14 has substantially the same mobility and rotatable components as those depicted by the arrows in FIG. 13 for work station 300. Moreover, each individual table 100, 100', 100" within work station 300 has the functionality and mobility described above.

The foregoing description provides embodiments of the invention by way of example only. It is envisioned that other embodiments may perform similar functions and/or achieve similar results. Any and all such equivalent embodiments and examples are within the scope of the present invention and are intended to be covered by the appended claims.

PARTS LIST

100 Table/Table Assembly
1 Frame (Frame members)
2 Swivel Casters (Movement members)

3 End of Frame Legs (Second End(s) of Each Frame Member)
4 Rotatable Bushing Configured Securely Receive Table top
5 Lock Wheel Hardware (for fixing Lock wheel to frame)
6 Spacer
7 Table top
8 Rotating Lock Pin
9 Table Hardware (for fixing Table top rotatable bushing and rotating lock pin)
10 Shelf (Storage Shelf Affixed to/Between Legs of Frame Member(s))
11, 15, 25, 26 Bracket (Cross-Beam)
12 Rotating Lock Pin Wheel (Rotating Disc)
13 Handle (operably connected to lock pin wheel and bushing to selectively rotate table top)
14 Plate
16 Quick Release Locking Pin
20 Locking Wheels
21, 22 Holes (Plurality of Through Holes On Rotating Disc)
$A^1$ Axis of Rotation (for Table Top) And Axial Alignment of Bushings
27 Individual Frame Legs
200 Fastening Device
201 First End configured for fastening to a selectively rotatable table top of a first mobile table
202 Second End configured for fastening to a selectively rotatable table top of a second mobile table
300 First Exemplary Workstation
400 Conveyor Belt
450 CNC machine or 3D printer
480 Robotic Arm
481 Computer Operatively Connected To Robotic Arm
500 Second Exemplary Workstation

What is claimed is:

1. A work station comprising a plurality of mobile tables, wherein each mobile table comprises:

a selectively rotatable table top that is configured to securely rotate about an axis ($A^1$) in an unlocked position and to be secured in a predetermined plane in a locked position; and two spaced apart frame members securely connected to the selectively rotatable table top positioned on a first end of each spaced apart frame member and movement members attached to a second end of each spaced apart frame members that are configured to selectively move the mobile table to and from desired locations wherein:

each frame member comprises two spaced apart frame legs that are connected to one another on the first end of the frame member by a cross-beam and the cross-beam of each frame member is co-planar relative to one another within the table;

the selectively rotatable table top of each mobile table is configured to selectively rotate and lock in a clockwise or counterclockwise direction relative to the frame members;

the selectively rotatable table top of each mobile table is configured to selectively rotate to and lock in a first position that is substantially coplanar with the cross-beams of each frame member of the table and in a second position that is substantially perpendicular relative to the cross-beams of each frame member of the table;

the selectively rotatable table top of each mobile table is configured to selectively rotate and lock in a plurality of predetermined positions in between the first and second positions;

with a stationary storage shelf affixed to each mobile table between the two spaced apart frame members and below the selectively rotatable table top, the stationary storage shelf being more proximate to the second end of each spaced apart frame member than the first end of each spaced apart frame member to provide sufficient clearance for the selectively rotatable table top such that the selectively rotatable table top is configured to rotate 360° about the axis ($A^1$) in an unlocked position relative to the two spaced apart frame members;

the stationary storage shelf of each mobile table is in a parallel plane relative to the cross-beams of each frame member;

with two rotatable bushings in each mobile table, with each bushing positioned within the first end of the spaced apart frame member and extending internally within the table towards one another, the rotatable bushings are axially aligned with one another and have the selectively rotatable table top securely attached thereto with one rotatable bushing being operably connected to a handle such that when handle is moved/rotated the two rotatable bushings and selectively rotatable table top move in concert with the handle between desired unlocked and locked positions;

with a locking mechanism positioned in each mobile table that is configured to selectively lock and unlock the selectively rotatable table top in predetermined positions relative to the two spaced apart frame members; and the rotatable bushing that is operably connected to the handle in each mobile table is coupled to a rotating disc having a plurality of through holes positioned thereon, the rotating disc configured to move in concert with the handle, two rotatable bushings, and selectively rotatable table top such that the locking mechanism selectively engages and disengages the through holes of the rotating disc to obtain the desired unlocked and locked positions of the selectively rotatable table top.

2. The work station of claim 1, wherein the work station comprises three mobile tables connected to one another.

3. The work station of claim 2, wherein each mobile table comprises casters allowing movement of the entire work station from a first location to a second location.

4. The work station of claim 1, wherein the work station comprises four mobile tables connected to one another.

5. The work station of claim 4, wherein each mobile table comprises casters allowing movement of the entire work station from a first location to a second location.

* * * * *